US011427991B2

(12) United States Patent
Ortiz Garcia et al.

(10) Patent No.: US 11,427,991 B2
(45) Date of Patent: Aug. 30, 2022

(54) FEMALE PART, RETAINING DEVICE AND PIN SYSTEM FOR EXCAVATORS AND THE LIKE

(71) Applicant: METALOGENIA RESEARCH & TECHNOLOGIES S.L., Barcelona (ES)

(72) Inventors: Justo Jesus Ortiz Garcia, Barcelona (ES); Joan Tuto, Fornells de la Selva (ES); Francisco Perez Soria, La Roca del Valles (ES); Jorge Triginer Boixeda, Barcelona (ES); Albert Gimeno Tordera, Barcelona (ES)

(73) Assignee: METALOGENIA RESEARCH & TECHNOLOGIES S.L., Barcelona (ES)

( * ) Notice: Subject to any disclaimer, the term of this patent is extended or adjusted under 35 U.S.C. 154(b) by 111 days.

(21) Appl. No.: 17/004,912

(22) Filed: Aug. 27, 2020

(65) Prior Publication Data

US 2020/0392704 A1 Dec. 17, 2020

Related U.S. Application Data

(62) Division of application No. 16/077,318, filed as application No. PCT/EP2017/053127 on Feb. 13, 2017, now Pat. No. 10,907,328.

(30) Foreign Application Priority Data

Feb. 12, 2016 (EP) ..... 16382058

(51) Int. Cl.
*E02F 9/28* (2006.01)

(52) U.S. Cl.
CPC ..... *E02F 9/2841* (2013.01); *E02F 9/2858* (2013.01)

(58) Field of Classification Search
CPC ..... E02F 9/2841; E02F 9/2858
USPC ..... 403/291, 376
See application file for complete search history.

(56) References Cited

U.S. PATENT DOCUMENTS

| | | | | |
|---|---|---|---|---|
| 2,050,014 A | | 8/1936 | Morrison | |
| 3,102,614 A | * | 9/1963 | Lydard | E04B 9/16 403/387 |
| 3,400,746 A | | 9/1968 | Petersen | |
| 3,740,876 A | | 6/1973 | Solokhin et al. | |

(Continued)

FOREIGN PATENT DOCUMENTS

| | | |
|---|---|---|
| EP | 2 730 705 A1 | 5/2014 |
| FR | 2 745 612 A1 | 9/1997 |

OTHER PUBLICATIONS

International Search Report for PCT/EP2017/053127, dated Jul. 24, 2017.
Written Opinion for PCT/EP2017/053127, dated Jul. 24, 2017.

*Primary Examiner* — Gary S Hartmann
(74) *Attorney, Agent, or Firm* — Sughrue Mion, PLLC

(57) ABSTRACT

A female part, a retaining device and a pin system have the device, the female part and a male part, to assure the retention between the female part and a male part used in excavators and the like. The female part has a cavity and can be a wearing element, a tooth or an intermediate part (part between a point and a weld on or cast nose in a three part system) and the male part has a nose to be introduced into the cavity of the female part and this will usually be a tooth-holder, intermediate, cast nose, weld-on nose or an adapter.

5 Claims, 9 Drawing Sheets

(56) References Cited

U.S. PATENT DOCUMENTS

| | | | | |
|---|---|---|---|---|
| 3,751,834 | A | 8/1973 | Petersen | |
| 3,753,582 | A * | 8/1973 | Graham | F16L 37/0885 37/459 |
| 3,826,024 | A * | 7/1974 | Petersen | E02F 9/2841 37/458 |
| 3,952,433 | A | 4/1976 | Heinold et al. | |
| 3,997,989 | A | 12/1976 | Stepe | |
| 4,240,177 | A * | 12/1980 | Harbison | B60S 1/40 15/250.32 |
| 4,367,602 | A | 1/1983 | Petersen | |
| 4,505,058 | A | 3/1985 | Peterson | |
| 8,287,543 | B2 * | 10/2012 | Medoff | A61B 17/809 606/74 |
| 9,512,598 | B2 * | 12/2016 | Rol Corredor | E02F 9/2833 |
| 9,512,599 | B2 | 12/2016 | Rol Corredor et al. | |
| 9,664,220 | B2 * | 5/2017 | Matheisl | B66B 23/14 |
| 10,106,961 | B2 * | 10/2018 | Rol Corredor | E02F 9/2858 |
| 10,385,577 | B2 * | 8/2019 | Ubiñana Felix | E04G 17/04 |
| 10,718,123 | B2 * | 7/2020 | Ubiñana Felix | E04B 1/2403 |
| 10,907,328 | B2 * | 2/2021 | Ortiz Garcia | E02F 9/2841 |
| 10,914,084 | B2 * | 2/2021 | Ubiñana Felix | E04G 17/04 |
| 2011/0058894 | A1 | 3/2011 | Heaphy et al. | |
| 2013/0269221 | A1 | 10/2013 | Pippins | |

* cited by examiner

FEMALE PART, RETAINING DEVICE AND PIN SYSTEM FOR EXCAVATORS AND THE LIKE

CROSS REFERENCE TO RELATED APPLICATIONS

This is a divisional application of U.S. application Ser. No. 16/077,318 filed Aug. 10, 2018, which is a National Stage of International Application No. PCT/EP2017/053127 filed Feb. 13, 2017, claiming priority based on European Patent Application No. 16382058.2 filed Feb. 12, 2016, each of these disclosures incorporated herein by reference in its entirety.

OBJECT OF THE INVENTION

The present invention relates to a female part, a retaining device and a pin system comprising said device, said female part and a male part, to assure the retention between the female part and a male part used in excavators and the like. The female part has a cavity and can be a wearing element, a tooth or an intermediate part (part between a point and a welded on or cast nose in a three part system) and the male part has a nose to be introduced in the cavity of the female part and this will usually be a tooth-holder, intermediate, cast nose, weld-on nose or an adapter.

The female part is coupled to the male part, maintaining these two parts coupled through a pin system comprising the retention device. The female part is coupled in a detachable manner to the male part and the position between both is maintained due to a pin that interacts with a retaining device that also keeps the pin in its position. Said pin system prevents the female part from coming out of its blocking position with the male part and therefore maintaining the coupling between both parts. The detachable coupling requires the removal of the pin from the coupling and the replacement of the female part and also of the retaining device, if necessary.

The present invention especially applies to the sector of public works, mining and quarrying.

BACKGROUND OF THE INVENTION

Excavators and the like, such as those used in public works and mining sites are used for moving and loading earth, ground and rocks. These machines are usually provided with a shovel, bucket or dipper attached to a mechanical arm. The shovel is provided with a blade on a front edge intended for engaging and penetrating the ground. To prevent excessive wear of the blade and to aid penetrating the ground, it is common to assemble a wear element associated with the blade projecting from the front edge thereof. However, said wear elements are also exposed to wear impacts and breakages, so they must be replaced, and furthermore, depending on the application, it may be desirable to change the type or the shape of the wear element. To facilitate said replacement, tooth bars, which are fixed to the blade of the shovel in a more or less permanent manner, and wear elements, are used such that each wear element is releasably retained to a tooth bar by means of a pin system. The pin in said pin system usually passes through the two orifices on opposite walls of the wear element and the duct crossing the nose of the tooth bar, fixing the wear element to said tooth bar through a male—female type assembly. To guarantee the connection between both parts, the pin is fixed in its assembly position by a retaining device that further contributes to prevent the pin from coming out of its position when the machine is in operation and the female part/male part/pin system is subject to large stresses.

When the female part and male part assembly is in operation, the pin tends to move against the force exerted on the assembly, and to prevent the pin from leaving the assembly, the retaining device keeps the pin in place maintaining the female part and the male part attached to each other. If not, the pin could come out of the coupling and therefore both the pin and the female part may be lost. The fall of a female part and/or pin could be harmful depending on the work site thereof, possibly causing breakdowns in other machines, such as crushers, working on the same production site as the machine using the teeth, such as mines or quarries for example. As mentioned, a retaining device associated with the pin is used to prevent the pin from coming out of its assembly position between the female part and the male part, fixing the pin in said assembly position. The pin system, comprising at least one pin and at least one retaining device, tend to have elastic features provided to the pin systems by the retaining device, so that the pin can be fixed and released without requiring its breakage while at the same time allowing its introduction into, and extraction from, the system in a simple, preferably hammerless manner.

U.S. Pat. No. 3,952,433 describes a pin retaining system. The pin is introduced into the bore formed by the tooth and the tooth bar and the retaining device is provided with a clip in the form of a spring straddling the pin fixing it to its assembly position. Said clip is encapsulated in an elastomer element for the purpose of keeping said retaining element in its position. Encapsulating the retaining system in an elastomeric element makes the retaining system useless in tasks where the working temperature is very high since the properties of the elastomer material are lost increasing the possibilities of losing the pin. Furthermore, the use of an elastomeric element causes interference problems between elements since it has an uncontrolled deformation by pressure. Another feature of this retaining system is that the use of a clip in combination with an elastomeric material, and the positioning of the assembly in the adaptor element, means that the force needed to be used for assembling and disassembling the pin is high, the use of a hammer, which is unsafe for the user, being necessary and making it incompatible for hammerless systems.

The retaining system described in U.S. Pat. No. 3,997,989 comprises a pin of variable sections and a retaining system provided with two springs located in a washer shaped elastic element. The two springs of the retaining system have a straight area and a curved area of different section. Said washer with the two springs is positioned in a cavity in the adaptor element, then the tooth is assembled and then the pin, such that the section thereof causes the straight area of the springs to open being compressed until reaching notches located in the pin, and when the notches of the pin find the straight areas of the springs the latter are fixed in the notches preventing the pin from coming out. Like the U.S. Pat. No. 3,952,433, the use of an elastic material prevents this system from being used in applications where the temperature is very high (over 1200° or 1400°). Furthermore, the force needed for assembling and disassembling is high preventing its use in hammerless systems. Another drawback of this invention is that the retaining device, or washer, does not maintain its position within the cavity by itself and requires the coupling between the tooth and tooth bar.

In view of the known prior art documents the present invention provides a female part for excavators and the like that comprises two holes on a wall, a first hole for allowing the introduction of a pin and a second hole for attaching a retaining device inside the cavity of the female part. Said retaining device that is directly attached by attaching means to the inside cavity of a female part that is to be coupled to a male part in excavators and the like. Said retaining device is placed laterally inside the female cavity, between the wall of the cavity and the wall of the male part when both parts are coupled. In said position the retaining device is protected from the shocks of the nose inside the cavity when the coupling is in operation. The attaching means allow the retaining device to be attached to the female in such a way that the attaching means integrate within the female part. Further, the retaining device can be attached to the female part at the manufacturing facility and therefore both elements, female part and retaining device, can be delivered together as one component to the working site. At the working site the female part will be coupled to a male part and a pin will guarantee the coupling between the male and female part through the interaction of said pin with the retaining device. When the female part, a tooth or an intermediate part as a wearing element, has to be replaced because it has worn out, the retaining device is changed at the same time, therefore guaranteeing a correct operation as all the components are new. The introduction and extraction of the pin from the coupling is made in a hammerless way, which means that no hammer shocks are necessary for introducing or extracting the pin. In fact the pin is extracted by rotating the pin, which makes this pin system an easy system to use.

This type of retaining device, attached inside the cavity of a female part solves the previous problems of the state of the art solutions, such as no use of elastomeric material, no interferences, no additional force to detach the retaining device and no issues when working at high temperatures. Additionally, the female part can have the retaining device attached inside the cavity at the same factory where the female part is manufactured and both elements can be transported together to the working site. The female part with the retaining device attached, allows a quick replacement of the female element when it has worn out because the retaining device for the pin is already attached inside the cavity of the female part.

Description of the Invention

For the purpose of overcoming the mentioned drawbacks as well as simplifying the assembly and disassembly of a male and female parts for excavators and the like, coupling both parts by means of a pin housed in a duct formed between the female and the male parts so that the male part is secured in the female part, a first object of the present invention is a female part with means to attach a retaining device inside its cavity that will interact with the pin and maintain the coupling between the female and the male part.

A second object of the present invention is a retaining device.

A third object of the invention is a pin system.

The female part is one of the main components of the coupling that comprises a cavity for the introduction within of the nose of a male part. Usually the female parts are teeth, points or intermediates (parts with a nose and a cavity to be placed between a point and a cast-on or welded nose) and shrouds and the male parts are usually adaptors, weld-on noses, cast noses or tooth-holders.

The male part is another main component of the coupling that comprises at least a nose for the introduction into the cavity of a female part. The male part can be a tooth-holder, an adaptor, an intermediate part, a cast-nose or a weld-on nose with the nose on one side to be introduced into the cavity of the female part and the required shape on the opposite side to be coupled or welded to a bucket of an excavator or the like.

In other cases, which are less frequent, the couplings are inverted and therefore the previous male and female parts are interchanged.

Prior art patent document No. U.S. Pat. No. 3,740,876, refers to a tooth and a tooth holder coupled by a pin crossing the tooth and the tooth holder. The tooth shows two parallel holes but it does not show nor describe either a retention structure or retention configuration within one of said hole as the present invention does. Further, prior art patent document No. U.S. Pat. No. 3,400,476, describes a retainer for an excavating tooth that does not show attaching means on the retaining device to couple the same to the cavity of the tooth, but to couple the retaining device to the tooth holder. The attaching means at the free ends of the retaining device are used to couple the same to the tooth holder male part and not to the tooth. Additionally, U.S. Pat. No. 3,400,476, does not refer to a retaining device that can be attached to one surface or wall of a female part.

However, during the description when reference is made to substantially parallel, it should be interpreted as differing +/−150° with the parallel position between two arms or sections.

Hook-shaped ends will be introduced into a hole, with the retention structure or retention configuration in one of the walls of the female element, as will be described later, to attach the retaining device to the female element. As mentioned, said hole can be a blind hole, that can only be accessed from the inside surface of the wall of the female element. Therefore, the hole is closed on the exterior surface of the female element. On the other hand, the hole can be a through hole, opened on both surfaces, exterior and inside, of the wall of the female element.

Furthermore, in this first solution, the first closed bent end of the retaining device, opposite to the hook shaped second end, may have a particular or specific shape that will contribute to maintaining the retaining device together with the attaching means in its position when the retaining device is attached to a female part. This particular shape of the first bent end requires that:

- near the first end of the retaining device each of the arms describe a first curve towards the hook-shaped end,
- said first curve is followed by a first arm section,
- said first arm section is further followed by a second curve, contrary to the first curve (if the first curve is clockwise this would be counterclockwise or vice versa),
- said second curve is followed by a second arm section, and
- after said second arm section finishes at a third curve that determines the bent end of the device.

As mentioned, the term "contrary" means that both curves are contrary in sense or that if the first curve describes a clockwise path, the second curve describes a counterclockwise path. Furthermore, it should be mentioned that the sections of one arm are substantially parallel to the corresponding sections of the other arm of the retaining device, and that the bent end is preferably contained in the same plane as the last free section of the hook-shaped ends, although this is not compulsory. The shape described by this end of the retaining device is similar to a stair step.

Specifically, looking over the retaining device starting from the second end of one of the arms towards the first bent end, said first arm would describe a first straight sector followed by a first curve that bends the arm in a clockwise sense between 70° and 120°, preferably 100°, towards a second straight sector, followed by a second curve that bends the arm in a counterclockwise sense between 90° and 140°, preferably 120°, and followed by a third straight sector that ends on a curve that determines the bent end of the retaining device. This bent end can be completely curved or comprise a straight sector, meaning that the bent end can be U-shaped with curved angles at the sides of the straight sector or describe a curve without a straight sector. After the bent end, the second arm starts to describe a path the same as the one of said first arm, being all the three sectors of both arms substantially parallel between them.

Preferably, the length of both second and third sectors is similar and preferably about 7,5% of the length of the first straight sector. The length of the first straight sector of each arm is between 70% and 95% of the total length of the retaining device. Furthermore, the distance between the first straight sectors of each arm is between the 10% and 30%, preferably 20%, of the total length of the retaining device. However, these proportions between sections may change depending on the size of the female and male part.

As previously mentioned, on the second end of the retaining device, opposite to the first bent end, both arms have hook-shaped ends ending each arm on a last free straight section. These hook-shaped ends can be curved in this first solution in the same sense as the first curve of the arms near the bent end.

Further, in an alternative solution, the two arms that define the bent device with U-shaped body might not be parallel, meaning not substantially parallel, at least previous to being attached to the female part. The fact of not being parallel previous to being attached to the female part and after being attached being substantially parallel, allows the retaining device to be fixed to inside the hole with the retention structure or retention configuration of the female part due to force exerted by the free hooked-shaped ends against the surfaces of the hole. As already explained, said hole with retention structure or retention configuration can be a through hole on the wall of the female device or a blind hole that is closed on the exterior surface of the wall of the female device. Alternatively, a second solution of a retaining device with attaching means comprises as attaching means, on the second end of the device, two components that are detachable one from the other, being one of the components attached to the free ends of the second end of the device and maintaining both ends together, closing the retaining device. In this second solution, both ends are curved one towards the other, therefore the end of one arm goes towards the opposite arm, being the last section of the hook-shaped end of each arm kept together by one of said components of the attaching means. To allow the two components to be attached and detached, each of the components is threaded so that they can be screwed one to the other.

Accordingly, and as will be described, the retaining device is attached to the female part through the two components that will fasten it to the wall of the female part that will be placed between both components. The first component, that maintains both free ends of the retaining device together, is preferably a hollow cylinder with a thread inside that is crossed through orifices by the free ends of the arms of the retaining device. This first component is to be threaded to a second component that has an exterior thread on one end and a hexagonal shape on the other end. Both components are screwed together to attach the retaining device to the wall through the hole.

An alternative to the above construction is a first component that could be a cylinder too, with a threaded exterior surface and the second component a nut with an inner surface.

Due to the threaded relation between both components they can be attached and detached one from the other. The retaining device will be introduced inside the cavity with the first component attached to said second end placed inside the cavity and will be attached to the female part with the assistance of the second component that will be threaded to the first component from the external side of the female part.

According to the above, an object of the invention refers to a female part for excavators and the like, comprising a body with a cavity with a bottom end, an open end and walls, one upper wall, one lower wall and two side walls, wherein at least one of said walls has a first hole that goes through it, for the insertion of a pin after being coupled to a male part, and further comprises a second hole with a retention structure or configuration within the hole, to introduce the attaching means of a retaining device. Said second hole can go through the same wall, as a through hole, crossing the wall of the female device, or can be a blind hole, closed on the exterior surface of the wall of the female device. Said second hole is placed on the same wall as the first hole and towards the bottom end of the cavity and separated from said first hole. The centers of the first and second holes are placed in the same axis, being both holes symmetric in respect to said axis or said axis dividing the wall of the female part in two similar sized parts. Said first and second holes are placed within a flat recess or lowered surface in the wall inside the cavity. Further, the depth of the lowered surface will preferably be the same or slightly larger than the width of the elongated body of the retaining device to prevent the interference of the retaining device attached inside the female part with the male part when the male part is introduced into the cavity of the female part. The lowered surface could alternatively be placed on the outside wall of the nose of the male part so that the interference would also be prevented too when the male part is introduced within the cavity of the female part.

Furthermore, and depending on the retaining device to be used, mainly when the first described solution of a retaining device is used, the female part comprises a groove. This groove is to introduce the first bent end opposite to the attaching means of a retaining device, placed inside the cavity of the female part, on the same wall as the first hole and going towards the open end of the cavity separated from said first hole. The depth of said groove is greater than the depth of the recess or lowered surface where the holes are placed because when the retaining device is placed inside the cavity, the bent end is introduced within said groove, the hooked-shaped end is attached to the second hole and the two longer arms that define the retaining device are very close or in touch with the lowered surface. The groove is therefore at a lower level in the wall than the lowered surface.

The outside surface adjacent to the first hole for introducing the retention pin can comprise two inclination ramps opposite to one another and concentric to said orifice. These ramps allow rotating the pin in both directions when it has to be removed from the coupling. Said ramps have a window that is used to determine if the pin, once installed, is correctly placed, or not, within the first hole.

The groove, whose purpose is fixing the first bent end of the retaining device by introducing said end in the groove, comprises a slot within the wall of the female element that has a larger depth than the depth of the lowered surface. The groove is placed within the wall with at least one aperture to allow the introduction in the wall of the bent end of the retaining device. Said groove can be T-shaped, for manufacturing reasons although other constructions are possible. If it is T-shaped, the narrower side of the groove is at the upper level of the wall of the cavity, on the inside surface of the cavity, and the wider side or slot of the groove determines the lower level of said wall, which is below the level of the recess or lowered surface in the wall inside the cavity, therefore at a larger depth. An alternative is that the grove is only a slot within the wall of the female part.

The second hole, for attaching the second end of a retaining device to the female part, may have different retention structures or retention configurations depending on the retaining device to be fixed to the female part, and can be T-shaped, circular-shaped, or hexagon shaped among other possibilities. Said second hole can be a through hole or a blind hole.

When the first solution retaining device, the one with hook-shaped ends, is to be attached to the second hole, this hole is preferably T-shaped, with an horizontal side or slot of the T directed to the first hole of the female part and a vertical side or slot, wherein the T-shaped hole is on an intermediate surface placed between the inside surface and exterior surface of the wall. Said intermediate surface is placed at both sides of said horizontal slot, being said intermediate surface connected to the inside surface of the wall through another surface.

To allow the introduction of said free ends through the horizontal or long slot of the T-shaped hole both ends are pressed together. When afterwards both ends are released they would separate moving to the sides of the vertical slot or short slot of the T-shaped hole and would be supported on the intermediate surface of the hole. The T-shaped hole allows the free ends to be placed on its intermediate surface facing the exterior of the female part, but inside the hole so that said free ends do not interfere with the outer surface of the wall of the female part. The surface of the hole facing the exterior of the female part, that supports the hook-shaped free ends, can be substantially parallel to the lowered surface inside the cavity or not parallel at all.

Alternatively, the T-shaped hole may be blind, meaning that it can only be accessed from the inside surface of the female element, where the hole is made with the retention structure, and therefore closed on the exterior surface of said wall.

On the other hand, when the second solution retaining device, the one with two components, is to be attached to the second hole, this hole is preferably of circular or hexagonal shape.

The female part is to be coupled to a male part that comprises a nose to be introduced into the cavity of the female part, wherein said nose can be traversed by a duct for housing the retention pin during the coupling of the female part to the male part. The nose is preferably completely traversed by a duct with two access orifices and in which the pin will be housed by passing through after the female part and the male part have been coupled together. On occasions the duct does not traverse the entire nose, i.e., said duct does not need to be a through duct. Preferably, when the duct in the male part traverses the nose, the female part will have also two holes for receiving the pin, but this is not compulsory.

Before the coupling of the male part and the female part, the retaining device, that will serve to withhold the pin in its place, has to be attached to the cavity of the female part. As previously described there are two types of retaining devices with different attaching means, and depending on the shape of the second end of the retaining device, the attaching means of this second end and the shape of the second hole in the female part will change.

For the attachment of the retaining device where the attaching means are determined by the hooked-shaped free ends of the arms, or the first solution of retaining device, the second hole, blind or not, of the female part will have, as previously described, a T shape, being the horizontal side or slot of the T directed to the first hole of the female part and the intermediate surface on both sides of the horizontal slot of the T. To attach this second end of the retaining device to the inside wall of the female part, the two arms on this end should be brought together by exerting pressure and afterwards be passed through the vertical side or slot of the T in the T-shaped second hole of the female part. For this purpose and to achieve an expansive force on the arms that serve to firmly attach the free ends of the device within the second hole the distance between the arms at the free ends is greater that the distance at the first bent end. Once the last straight sectors of the hooked-shaped ends of the arms have crossed the second hole, the pressure exerted on both arms should be released and the second ends of the arms will separate and the hooked-shaped ends will embrace the wall of the female part, being the last straight sector of each arm supported on the intermediate surface of the horizontal slot of the T-shaped second hole.

To prevent dirt from getting into the female part as well as to prevent movements of the female part due to shocks a plug is introduced into said second hole, on the outer side of the female part, blocking the position of the retaining device as well as preventing the entrance of dirt inside the female element. When the T-shaped hole is blind on the exterior surface of the wall of the female device the plug is obviously not required.

Additionally, and to prevent the first solution retaining device from pivoting in respect to the second hole, the first bent end of the retaining device is introduced into the groove in the female part, that is on the opposite side from the second hole over the first hole, near the opening of the cavity. This has to be done before attaching the second end to the second hole The whole retaining device is kept within the recess or lower surface of the wall inside the cavity, being the depth of the recess or lower surface the same or slightly larger than the width of the elongated body of the retaining device.

On the other hand, for the attachment of the retaining device with attachment means that comprise two components where one of them maintains the free ends of the arms of the retaining device together, therefore in the second solution for a retaining device, the attaching means are placed within the second hole of the female part that preferably has a circular shape, although other geometries are possible. As the attaching means comprise two components detachable one from the other, and one of the components, the first component, is attached to the last straight section of both arms, coinciding with the free ends of said arms, this first component of the attaching means is introduced through the second hole of the female part from inside the cavity to the outside of the female part. The second component is therefore attached to the first component through the outside of the female part. The attaching means between both components are preferably threaded means to attach and detach one component from the other. For example, the first component attached to the retaining device is a hollow cylinder crossed by the last straight sectors on the free ends of the arms and with a thread in the inside or outer surface, wherein the second component, for example a nut, is threaded to the cylinder crossing the second hole of the female part.

A further alternative to this second solution of retaining device comprises attaching means with only the component that maintains the free ends of the arms of the retaining device together. Said component, as in the previous solution is placed within the second hole of the female part, but as there is no second component that will contribute to maintain the attaching means in place, the first component is introduced under pressure into the second hole. Said only component of the attaching means should have at least the same, or slightly larger, diameter as the diameter of the second hole to be held in place when the second hole is circular. If the second hole is not circular, the section of the component should be the same, or slightly larger than the section of the second hole. Therefore, the component would be maintained in place due to the measures of the hole and component, with zero tolerance between them, and that mechanically prevent the component from, and therefore the retaining device, releasing from the second hole.

In both solutions for retaining devices, the retaining device is fixed inside the cavity with the arms of the first sector crossing the first hole where the pin will be introduced, being the distance between the parallel arms of the first sector of the retaining device smaller that the diameter of the first hole.

Once the retaining device is attached inside the cavity of the female part, and more specifically in the recess of the inside wall of the cavity, the nose of the male part, which is fixed to the blade of the bucket, is slid into the cavity to couple said male part and female part. The retaining device sits between the surface of the recess of the cavity and the surface of the nose of the male part when the nose is inside the cavity. In this position, with the retaining device interfering with the first hole of the female part and located between said first hole and the entrance to the duct of the nose in the male part, the pin is introduced through the first hole of the female part. The pin causes the separation of the first sectors of both parallel arms of the retaining device and allows the introduction of the pin until at least one of said parallel sectors meets at least one notch or slot made on the surface of the pin that houses the sector of the arm. To allow the separation of the two arms of the retaining device when the pin passes between both of them, the recess or lower surface of the wall, should contain the surroundings of the first hole increasing in height. In this position, the pin is fixed inside the coupled male and female parts in a retaining position, being the coupling between both parts tight and preventing both parts from separating.

To release the pin it will only be necessary to rotate the pin with a tool introduced into a housing at the base of one end of the pin that will release the pin from the parallel sectors of the arms as they will come out of said notch or notches in the pin.

As mentioned, a pin system for coupling a male part and a female part of excavators and the like is also object of the present invention. Said pin system comprises a duct in a male part; a female part with the features previously described; a retaining device according to any of the two different embodiments described; and a pin that crosses the first hole on the wall of the female part, and passes between the two arms of the retaining device and further crosses the duct of the male part. Said pin comprises at least one slot or notch on its surface to receive one of the arms of the retaining device.

BRIEF DESCRIPTION OF THE DRAWINGS

To better understand the previous description, drawings in which several practical embodiments are depicted schematically and only by way of non-limiting example are attached.

DESCRIPTION OF PREFERRED EMBODIMENTS

The present invention and its embodiments will now be described attending to the figures and the numerical references contained therein.

Figure 1:
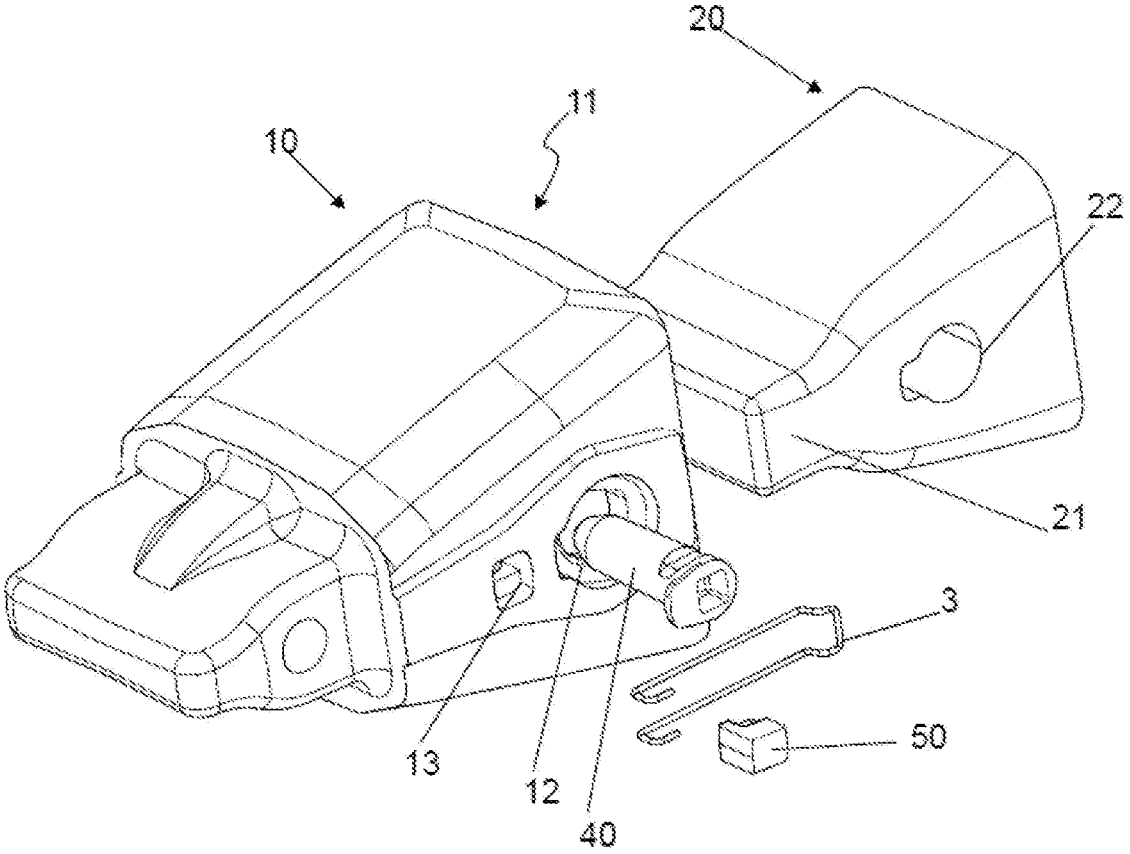
FIG. 1 shows an exploded view of a coupling between a female part and a male part.
Figure 2:
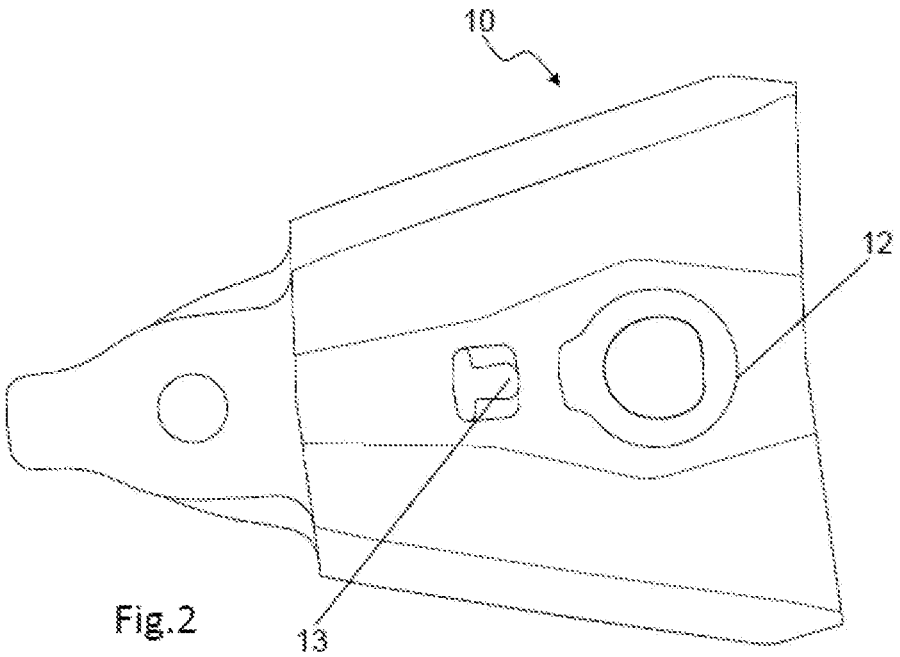
FIG. 2 shows a lateral view of a female part.
Figure 3:
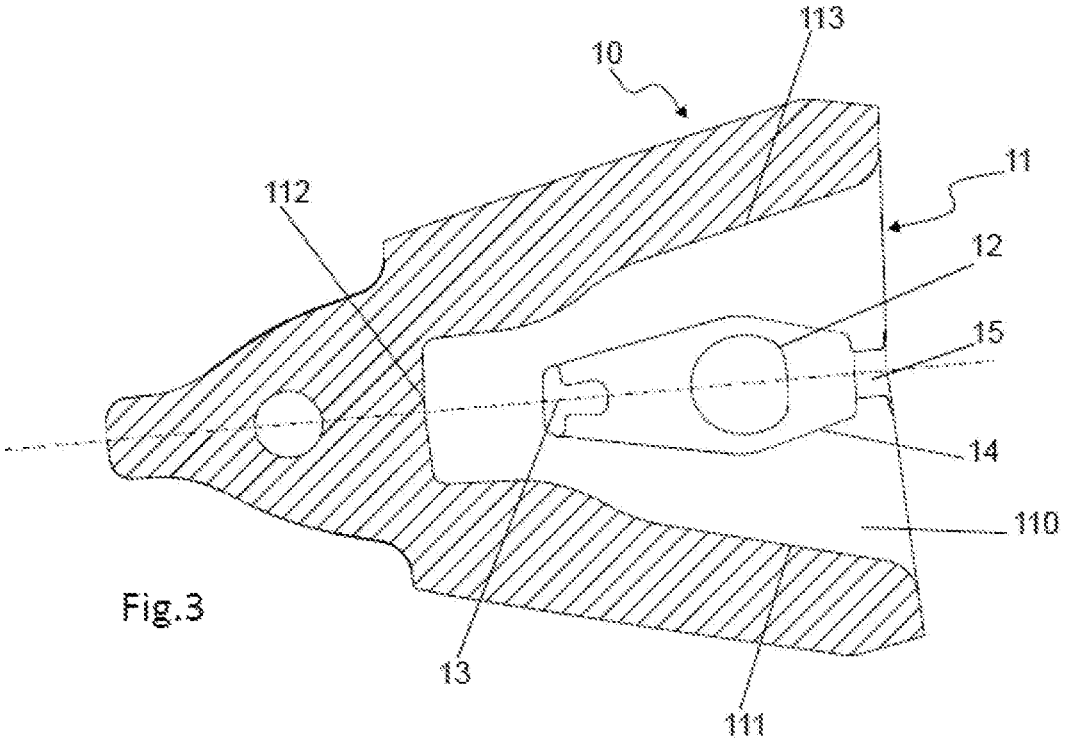
FIG. 3 shows a lateral section of a female part.
Figure 17:
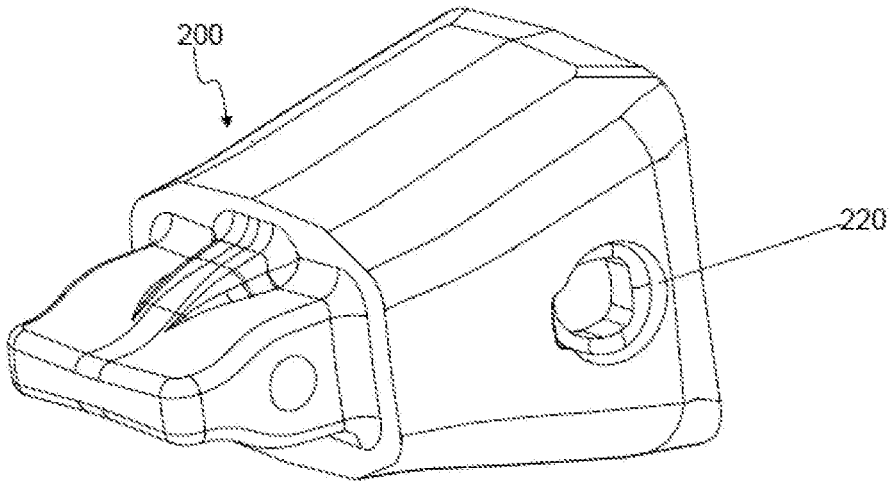
FIG. 17 shows a perspective view of another embodiment of a female part with a second hole that is blind in the inside surface of the wall.
Figure 18:
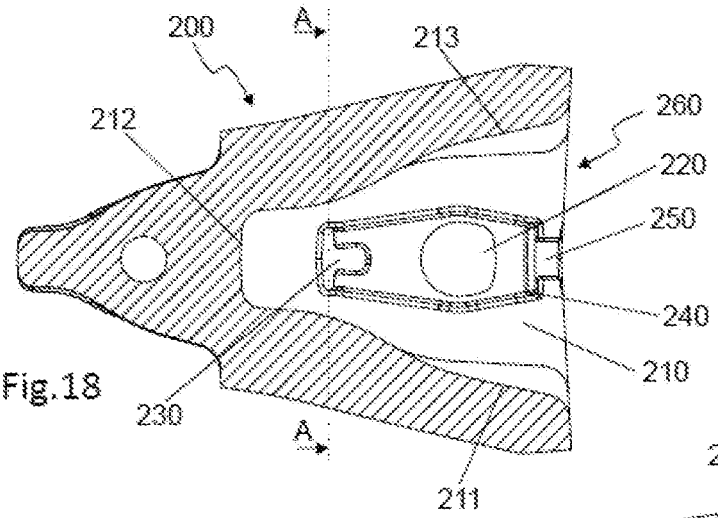
FIG. 18 shows a lateral section of the female part of FIG. 17.
Figure 19:
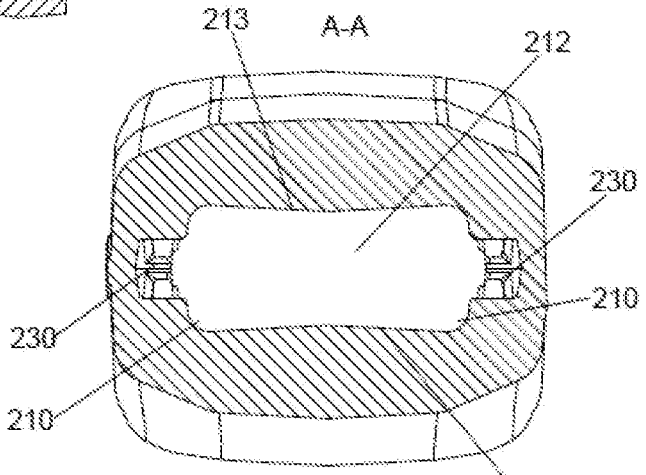
FIG. 19 shows a transversal section of the female part of FIGS. 17 and 18 through the second hole.

FIGS. 1 to 12 refer to a first embodiment of a retaining device, an intermediate element as female part 10 and pin system, while FIGS. 13 to 16 refer to a second embodiment of the same elements. FIG. 1 also shows a tooth holder 20 with a nose 21. Further, FIGS. 17 to 19 show an alternative embodiment, similar to the one in FIGS. 1 to 11, where the second hole is not a through hole but a blind hole, opened on the inside surface of the wall of the female part but closed on the exterior surface of said wall.

Attending to the first embodiment, FIG. 1 shows an intermediate 10 as a female part with a cavity 11 on the rear side and a nose on the front side, a tooth holder 20 as male element with a nose 21 on the front side, a pin 40 to assure the coupling between the female part or intermediate 10 and the tooth holder 20, a retaining device 3 to be attached to a wall 110 inside the cavity 11 of the intermediate 10 through a retention structure or retention configuration. The wall 110 of the intermediate 10 comprises two holes, a first hole 12 that serves to introduce the pin 40 when the nose 21 is introduced inside the cavity 11, and a second hole 13, with a retention structure or retention configuration within, used to place the attaching means 36 of the retaining device 3 to the cavity 11 of the intermediate 10. Once the retaining device 3 is attached to the wall of the cavity 11, the nose 21 is introduced into said cavity 11 and the retaining device 3 remains between the outside surfaces of the nose 21 and the wall 110 of the cavity, with the duct 22 of the tooth holder 20 and the first hole 12 of the intermediate 10 aligned. Afterwards, to assure the coupling of both parts 10, 20 the pin is introduced through the first hole 12, goes between the retaining device 3 and enters the duct 22 in the tooth holder. Also a plug 50 can be placed in the second hole 13 to guarantee the position of the attaching means 36 of the retaining device 3 and to prevent dirt from getting into said second hole 13.

The retaining device 3 of this first embodiment comprises an elongated element 30 that determines a bent body with two substantially parallel arms 31 that extend from a first closed bent end 33 to a second end 39 that is opposite to the first one 33. Said arms are preferably straight between both ends 33, 39. On said second end 39 both arms 31 have free ends 36 that make up the attaching means 38 with a hook-shaped end 38 of said retaining device 3 to the intermediate 10. These attaching means 38 with hooked-shaped ends 38 are made up of the straight ends of the retaining device 31, followed by a section 34 and the free ends 36. Furthermore, the attaching means 38 are placed in the second hole 13 of the intermediate and are determined by hook-shaped ends 38 comprising the last free ends 36 ending each arm 31. This last free section or end 36 of the hook-shaped ends 38 are contained in a plane that is substantially parallel to the plane that contains both arms 31 of the device 3.

On the other hand, and on the other side of the device 3, and to help to position the retaining device 3 in the wall 110 of the cavity 11 as well as to guarantee that the retaining device 3 does not move when placed in the cavity 11 of the intermediate part 10, the first bent end 33 of the device 3 has a particular shape that is used to be introduced into a groove 15 in the wall 110 of the cavity 11 of the intermediate part 10. This particular shape specifically describes near the bent end 33 and on each of the arms 31 the following path:

- A first curve (c1) towards the hook-shaped end followed by a first arm section 32,
- A second curve (c2) after the first section 32, that is contrary to the first curve (c1), and that is followed by a second arm section 35, and
- A third curve (c3) that determines the bent end 33 of the device.

The previous sections in one particular arm are substantially parallel to the equivalent sections of the other arm, while the bent end 33 is preferably at a similar height to the last free section 36 of the hook-shaped ends 38.

The first curve (c1) has an angle, $\alpha$, between 70° and 120°, preferably 100°, the second curve (c2) has an angle, $\beta$, between 90° and 140°, preferably 120°, and the third curve (c3) has an angle, $\gamma$, of about 90°.

The above retaining device 3 will be attached to a female part 10, in this example an intermediate 10, with a particular retention configuration. The intermediate 10 is delimited outside by an upper, a lower, and two side surfaces or walls and the internal cavity 11 is delimited by an upper surface 113, a lower surface 111, a bottom end 112, two side surfaces or walls 110 and an opening that gives access to the cavity 11 and that is on the opposite side of the bottom end 112.

At least one of said walls 110, although the two walls can be too, is provided with a first through hole 12 that traverses the wall for the subsequent introduction of a retention pin 40 after the intermediate part 10 has been coupled to the tooth holder 20. In this embodiment each of the side walls 110 has said first hole 12 and towards the bottom end 112 of the cavity comprises a second hole 13 with a retention structure or retention configuration. This second hole 13 is separated from the first hole 12 and the centers of each hole 12, 13 are preferably placed in the same axis being each of said holes symmetric in respect to said axis. The axis where the center of the holes is placed is preferably the axis that divides the wall of the female part into two similar size parts.

Furthermore, the inner side of the wall 110, where the first 12 and second 13 holes are placed has a groove 15, placed between the first hole 12 and the open end of the cavity 11, being said groove 15 aligned with said two holes 12, 13.

Said first 12 and second 13 holes, as well as the groove 15 are placed within a recess or lowered surface 14 practiced in the wall 110 inside the cavity 11, so that the depth of the recess or lowered surface of the wall 14 is smaller than the depth of the groove 15, which at the same time is the same or larger than the width of the elongated body 30 of the retaining device 3. Therefore, the groove 15 is at a lower level in the wall than the lowered surface 14. Said lowered surface 14 extends from the second hole 13 to the groove 15, containing said second hole 13, the groove 15 and the first hole 12, surrounding the same.

Figure 7:
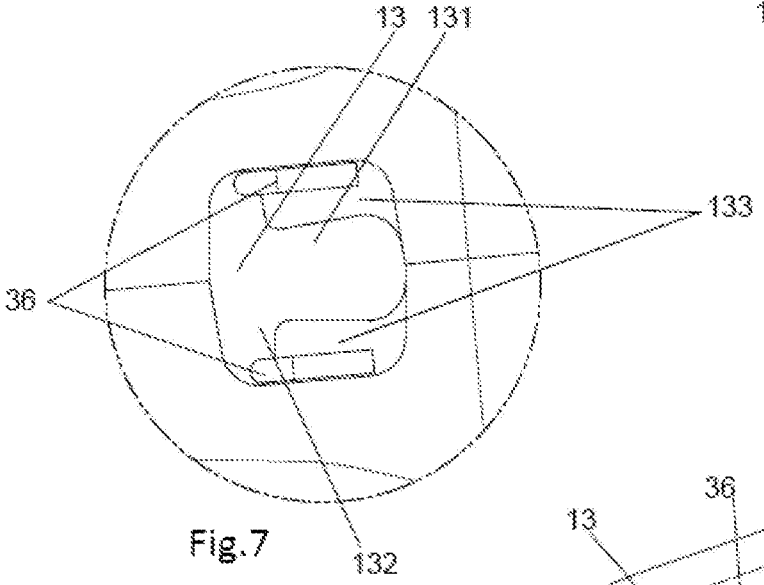
FIG. 7 shows a detail of the second hole in the female part.
Figure 8:
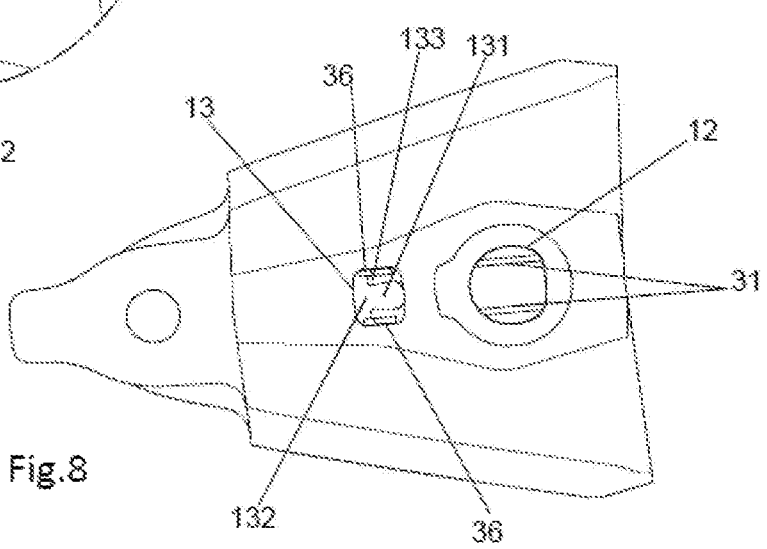
FIG. 8 shows a lateral view of a female part with a retaining device fixed to it.
Figure 9:
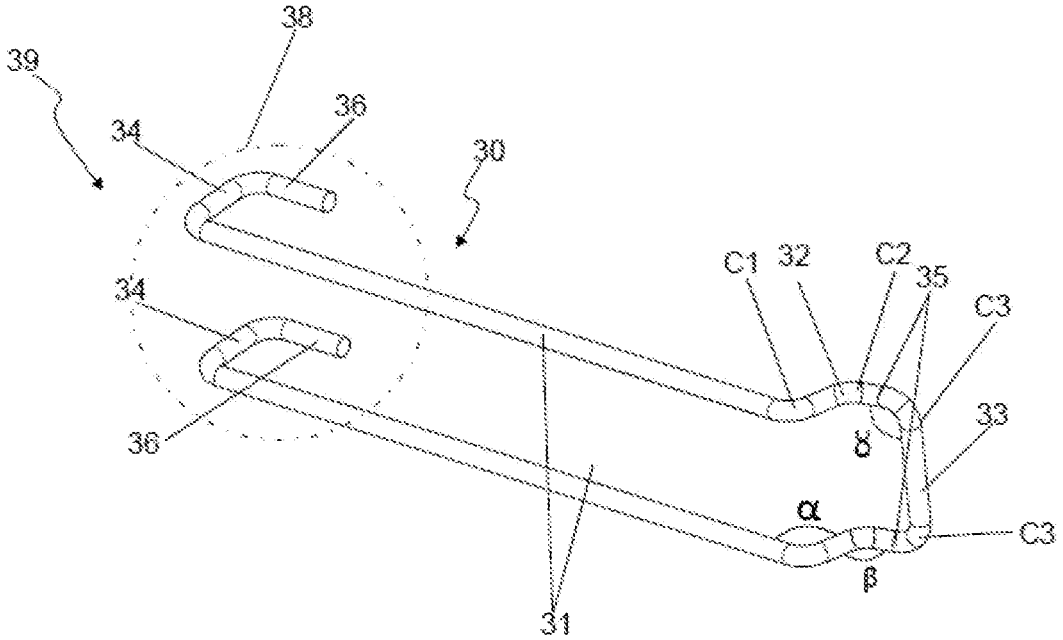
FIG. 9 shows a perspective view of a first embodiment of a retaining device.
Figure 10:
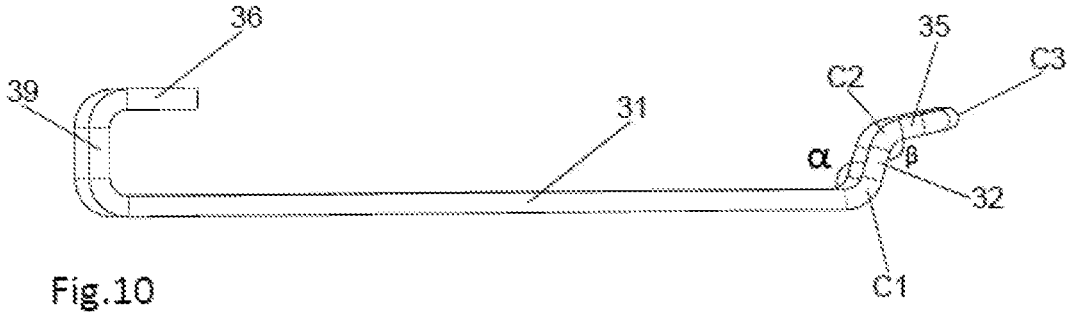
FIGS. 10 and 11 show different views of the retaining device shown in FIG. 9.
Figure 11:
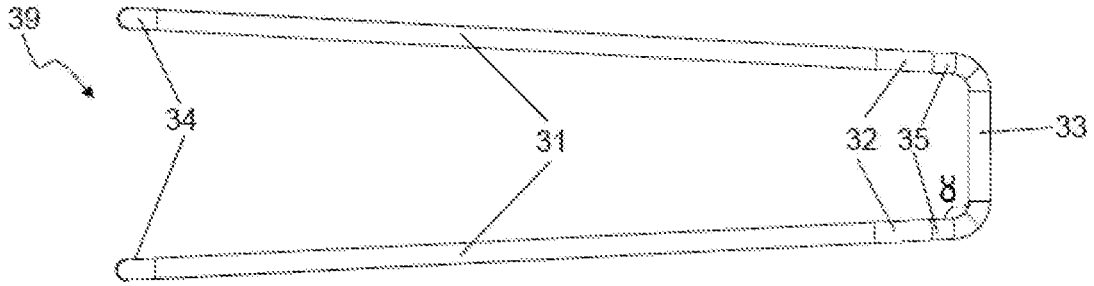
Figure 12:
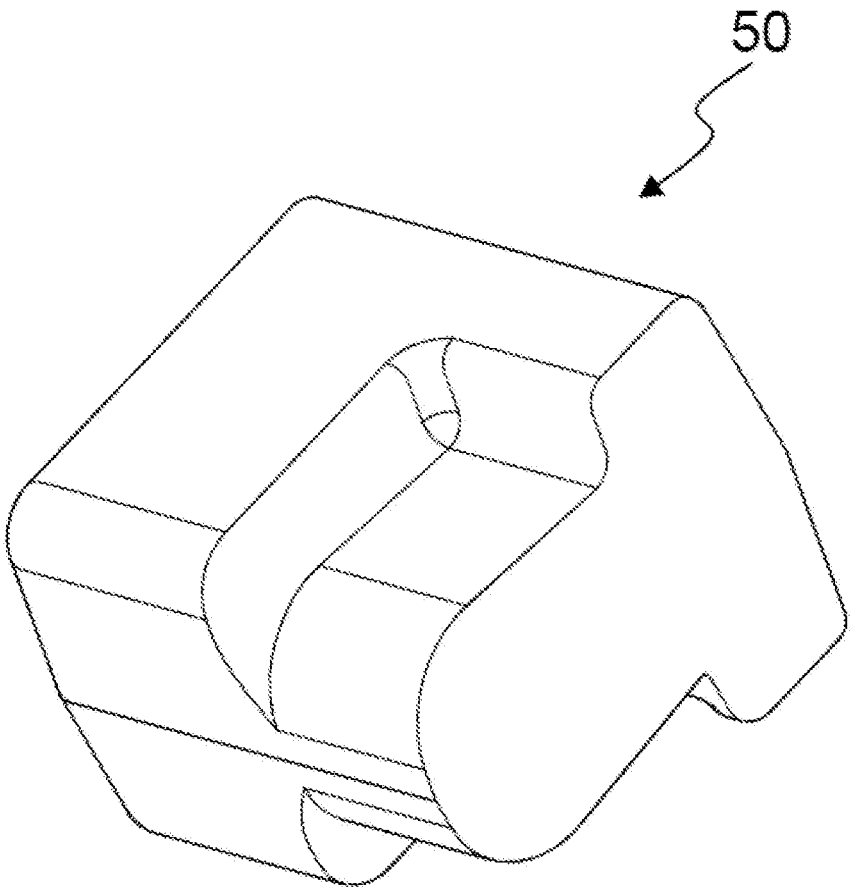
FIG. 12 show a perspective view of a plug.
Figure 13:
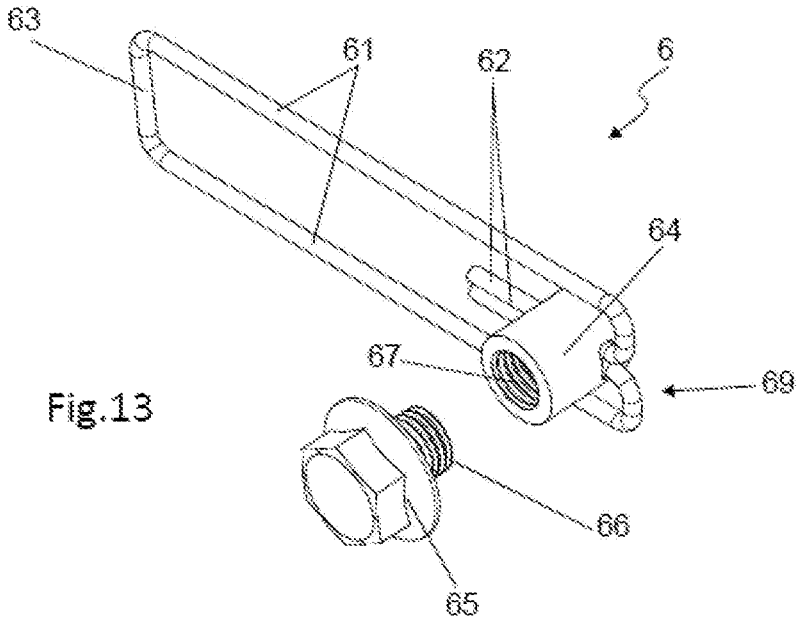
FIG. 13 shows a perspective view of a second embodiment of a retaining device.
Figure 14:
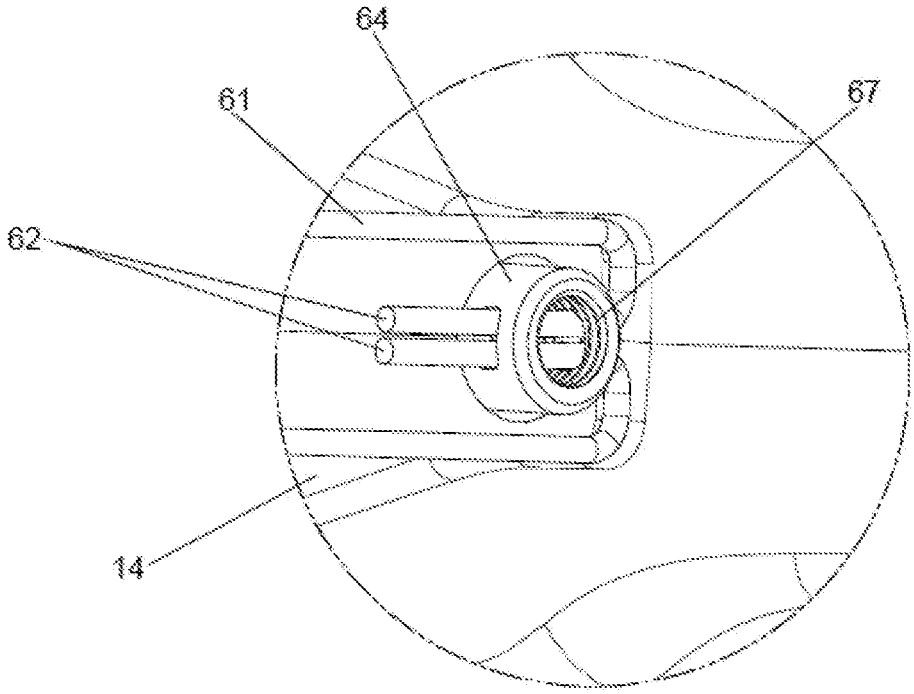
FIG. 14 shows a detail of the second end of the retaining device.
Figure 15:
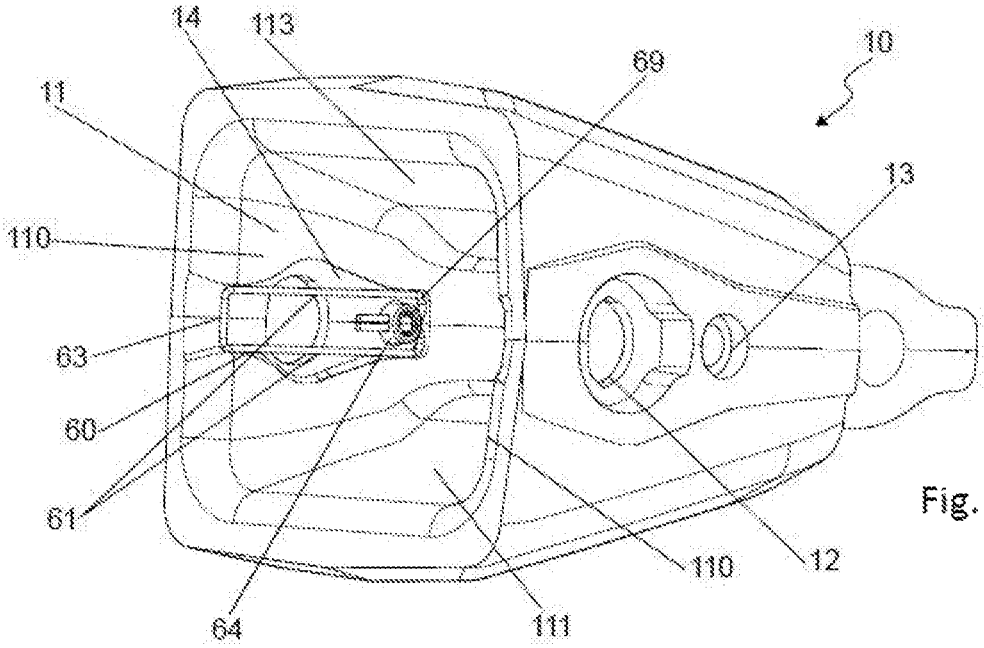
FIG. 15 shows a rear perspective view of a female part with the second embodiment of retaining device fixed to it.
Figure 16:
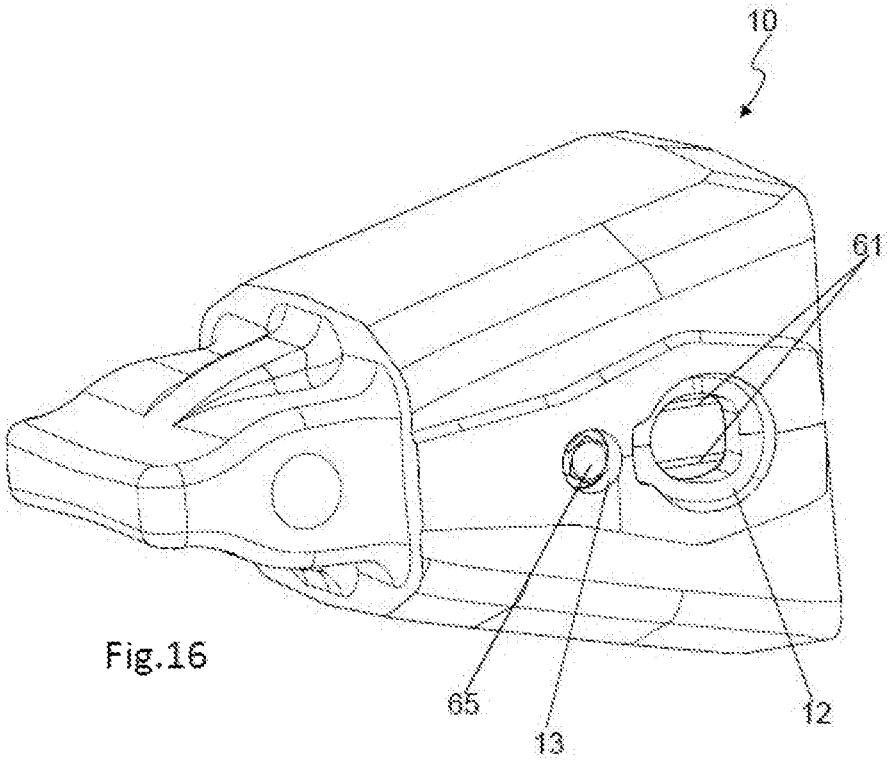
FIG. 16 shows a front perspective view of a female part with the second embodiment of retaining device fixed to it.

The shape of the first hole 12 is preferable circular although other shapes are possible depending of the cross section of the pin 40 to be introduced through the first hole 12. The shape of the second hole 13, determining the retention structure or retention configuration, is basically T-shaped, as can be seen in FIG. 7, with a horizontal slot 131 crossed by a perpendicular slot 132 that determine said T-shape. The horizontal side or slot 131 of the T is directed to the first hole 13 of the female part 10 and the vertical side or slot 132, perpendicular to said first side 132. At both sides of said horizontal slot 131 is determined an intermediate surface 133 between the inside surface and the exterior surface of the wall 110, being said intermediate surface 133 connected to the inside surface of the wall 110 through another surface.

Figure 4:
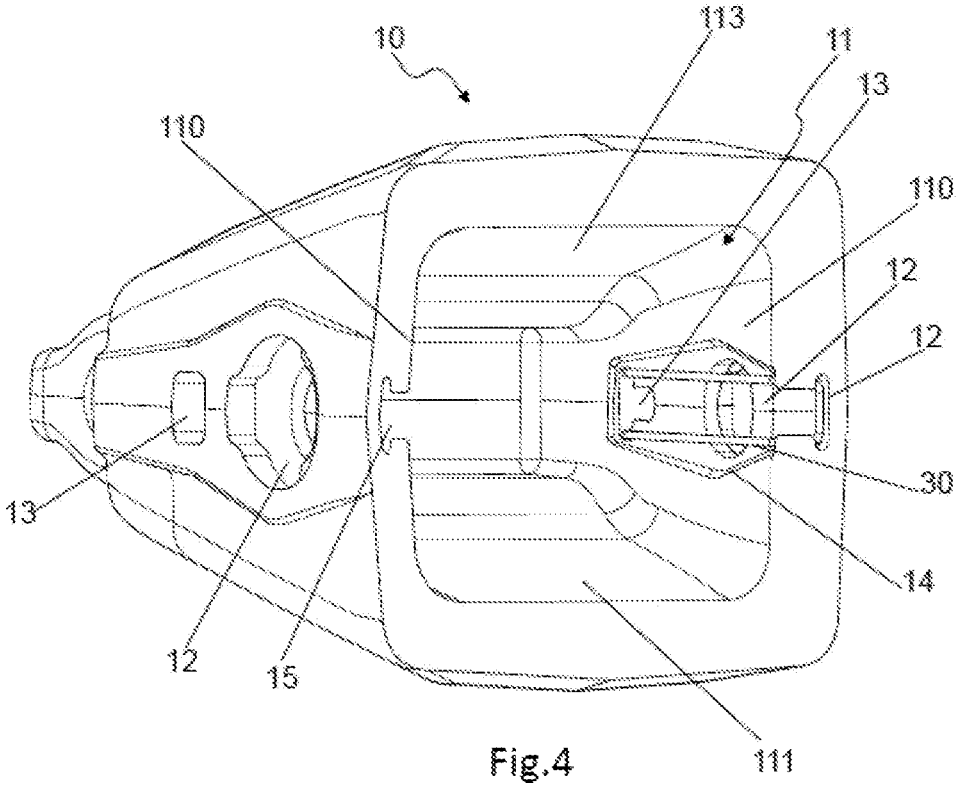
FIG. 4 shows a rear perspective view of a female part with a retaining device fixed to it.
Figure 5:
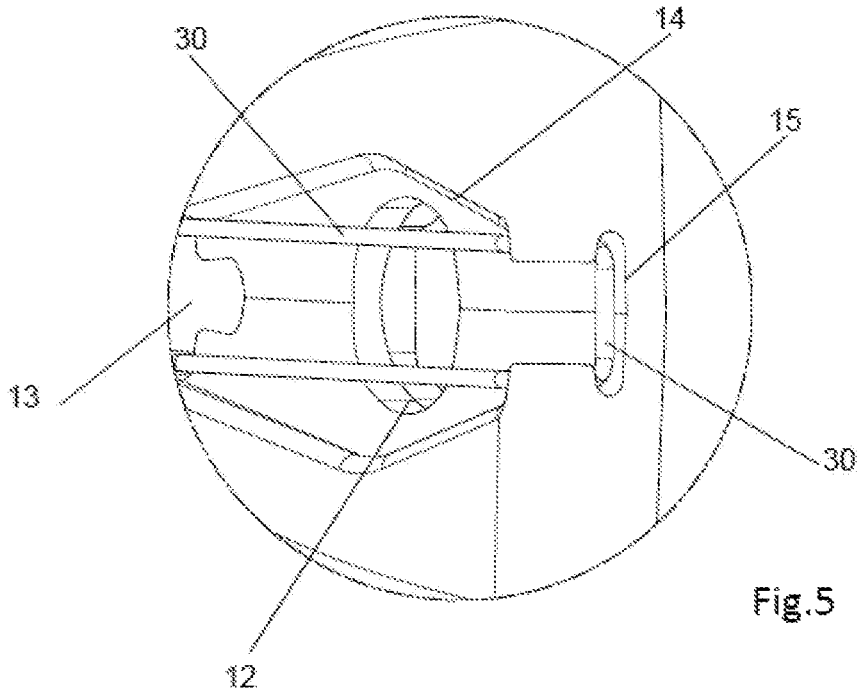
FIG. 5 shows a detail of the retaining device fixed to the female part.
Figure 6:
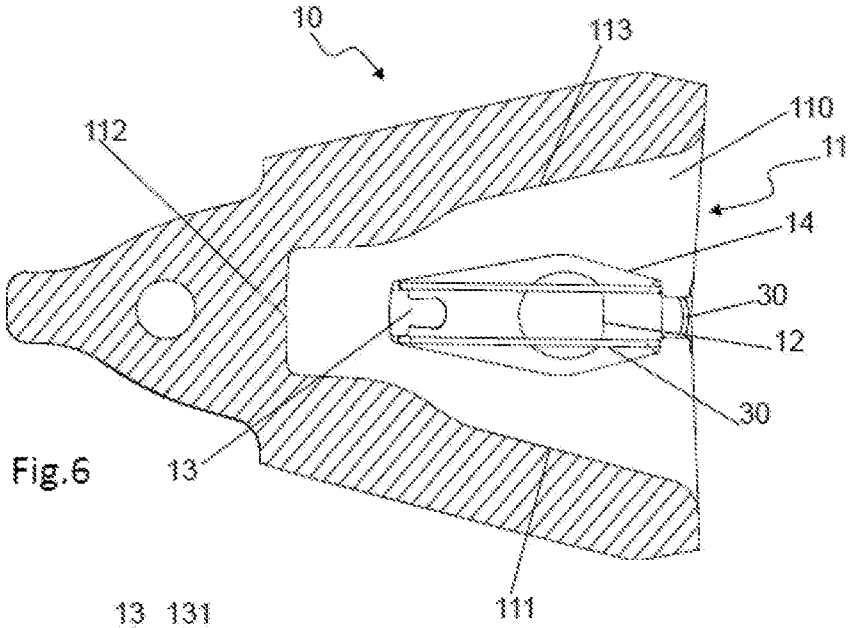
FIG. 6 shows a lateral section of a female part with a retaining device fixed to it.

Furthermore, the groove 15, as seen in FIG. 4, can also have a T shape, although is not compulsory, with the narrower side of the T groove 15 at the upper level of the wall 110 of the cavity 11 and the wider side of the T groove 15 determining the lower level of said wall 110 and being placed at the same level or below the level of the recess or lowered surface 14 in the wall 110. Anyway, other shapes for the groove 15 are possible, as the important feature of said groove is that the retaining device 3 is maintained inside the recces or lowered surface 14 preventing said retaining device 3 from moving in any direction. Therefore the groove 15 should be placed within the wall 110 with at least one aperture to allow the introduction in the wall 110 of the end 33 of the retaining device 3. Furthermore, the purpose of the lowered surface 14 is to position the retaining element 3 so that it does not interfere between the cavity 11 of the female part 10 and the nose 21 of the male part 20, and to prevent the retaining device 3 from moving backward or forward. The groove 15 could be independent of the recces or lowered surface 14 or connected to the same.

Before coupling the intermediate 10 and the tooth holder 20, the retaining device 3 has to be attached to the inside wall 110 of the intermediate 10. Therefore, the first bent end 33 of the retaining device 3 is introduced into the groove 15 to position the device 3 within the wall 110. Specifically, the second arm section 35 is placed inside the groove 15. Once the first end 33 is placed in the groove 15 the retaining device 3 should be attached through its attaching means 36 to the wall 110.

The attachment is made through the hooked-shaped ends 38 attaching means 38 in the arms 31 of the retaining device 3. Said hooked-shaped 38 ends are placed inside the second hole 13 so that the last free section 36 ending each arm 31 are positioned on the sides of the horizontal slot 131 of the second hole 13, specifically supported on the surface 133 within the hole 13 where the free ends 36 of the hook-shaped end 38 are placed, facing the outside of the wall 110. To attach this second end 39 of the retaining device 3 to the inside wall 110, the two last free sections 36 of each arm 31 are brought together by exerting pressure and afterwards are passed through the horizontal slot 131 of the T-shaped second hole 13. To achieve the expansive force on the arms 31 that serve to firmly attach the free ends 36 within the second hole 13 the distance between the arms 31 at the free ends 36 is slightly greater than the distance at the first bent end 33. Once the last straight sectors 36 of the hooked-shaped ends 38 of the arms 31 have crossed the second hole 13, the pressure exerted on both free ends 36 should be released and the arms 31 will separate so that the hooked-shaped ends 38 will embrace the intermediate surfaces 133 from the wall 110. As mentioned, the last free sections 36 will face the outside of the wall 110, supported on the intermediate surface 133, and the side section 34 of the hooked-shaped end will have the length of the surface connecting the inside surface of the wall 110 and the intermediate surface 133, and the other parts of the retaining device 3 will remain inside the cavity 11 of the intermediate part 10.

The second hole 13 can be closed by a plug 50 that has the counter shape of the hole 13 and prevents dirt from getting into the pin system. The plug 50 is introduced into said second hole 13, on the outside side of the intermediate 10, blocking the position of the retaining device 3 as well as preventing the entrance of dirt inside the cavity 11 of the intermediate part 10.

As can be seen in FIG. 4, the intermediate 10 comprises two retaining devices 3, one on each of the inside walls 110. However, the intermediate or female part 10 can include means for attaching the retaining device 3 only on one wall 110, independently of including one first hole 12 on each wall 110. The intermediate or female part 10 can even include means for attaching a retaining device 3 on both walls 110.

Alternatively, and as shown in FIGS. 17 to 19, a female part or intermediate 200 is shown with one first through hole 220 and a blind second hole 230. Said second hole 230 having the same retention structure or retention configuration to retain and receive the attaching means 36 of the retaining device 3 to the cavity 260 of the intermediate 200 as the second hole 13 previously described in FIGS. 1 to 12. Specifically, this second hole 230 of this new embodiment is T-shaped too but can only be accessed from the interior surface 210 of the wall of the intermediate 200, that is to say, from inside the cavity 260. As previously described for the embodiment in FIGS. 1 to 11, the female part or intermediate 200 comprises a cavity 260 delimited outside by an upper, a lower, and two side surfaces or walls and the internal cavity 260 is delimited by an upper surface 213, a lower surface 211, a bottom end 212, two side surfaces or walls 210 and an opening that gives access to the cavity 260 and that is on the opposite side of the bottom end 212.

As previously detailed, said first 220 and second 230 holes, as well as the groove 250 are placed within a recess or lowered surface 240 practiced in the wall 210 inside the cavity 260, so that the depth of the recess or lowered surface of the wall 240 is smaller than the depth of the groove 250, which at the same time is the same or larger than the width of the elongated body 30 of the retaining device 3. Therefore, the groove 250 is at a lower level in the wall than the lowered surface 240. Said lowered surface 240 extends from the second hole 230 to the groove 250, containing the lowered surface 240 said second hole 230, the groove 250 and the first hole 220, surrounding the same.

The retention structure or retention configuration of the second hole 230 for attaching the retention device 3 to the female element 200 is preferably the T-shaped structure as the one described for the embodiment in FIGS. 1 to 11.

Another embodiment of the present invention is shown in FIGS. 13 to 16. This retaining device 6 is to be attached to a female part 10 comprising a first hole 12 for the insertion of a pin 40 and a second hole 13, with an alternative retention structure or retention configuration, for attaching the retaining device 6 to the female device 10 as will be described.

The retaining device 6 in this second embodiment comprises one elongated element 60 determining a bent body with two substantially parallel arms 61 that extend from a first closed bent end 63 to a second end 69 opposite to the first end 63, where both arms 61 have free ends 62. On this second end 69 the retaining device 6 comprises attaching means 64, 65 for coupling the retaining device 6 inside the cavity 11 of the female part 10. These attaching means 64, 65 comprise two components that are detachable one from the other, and being one of the components 64 attached to the free ends 62 of the device 6 maintaining both free ends 62 together. These free ends 62 of the arms 61 are curved one towards the other, that is to say that the end of one arm faces the end of the opposite arm, determining a rectangular shaped retaining device 3.

The first component 64 that maintains both free ends 62 together is preferably a hollow cylinder 64 with a thread 67 inside that is crossed through orifices by the free ends 62 of the arms 61 of the retaining device 6. This first component 64 is to be threaded to a second component 65 that has a thread 66 on one end and a nut shape on the other end. Due to the threaded relation between both components 64, 65 they can be attached and detached between them.

The female part 10, where the previous retaining device 6 is to be attached, comprises similar features as the previously described female part or intermediate 10.

The female part or intermediate part 10 is delimited outside by an upper, a lower, and two side surfaces or walls and the internal cavity 11 is delimited by an upper surface 113, a lower surface 111, a bottom end 112, two side surfaces or walls 110 and an opening that gives access to the cavity 11 and that is on the opposite side of the bottom end 112.

At least one of said walls 110, although the two walls 110 can be too, is provided with a first through hole 12 that traverses the wall for the subsequent introduction of a retention pin 40 after the adaptor 10 has been coupled to the tooth holder 20. In this embodiment each of the side walls 110 has said first hole 2 and towards the bottom end 112 of the cavity comprises a second hole 13 with the retention structure or retention configuration. Said first 12 and second 13 holes are placed within a recess or lowered surface 14 practiced in the wall 110 inside the cavity 11.

The shape of the first hole 12 is preferable circular although other shapes are possible depending of the cross section of the pin 40 to be introduced through the first hole 12. The shape of the second hole 13, and of the retention structure or retention configuration, is basically circular for the introduction within of the first component 64 of the attaching means of the retaining device 6.

Before coupling the adaptor 10 and the tooth holder 20, the retaining device 6 has to be attached to the inside wall 110 of the female part or intermediate 10. Therefore, the first component 64 of the attaching means is introduced into the second hole 13 and the second component 65 is threaded to the first component 64 from outside of the female part 10 with the use of a tool and turning the nut shape of the second component 65. In this way, the retaining device 6 is attached to the female part 10 and placed with the lowered surface 14 inside the wall 110 of the cavity 11 of said female part 10.

Once the retaining device 3, 6 is attached in the cavity 11 of the female part or intermediate part 10, the same can be coupled to the tooth holder 20 by the introduction in the cavity 11 of the female part or intermediate 10 of the nose 21 of the tooth-holder 20. The retaining device 3, 6 will be situated between the inside wall 110 of the cavity 11 of the female part or intermediate 10 and the outside wall of the tooth-holder 20. Once coupled, the coupling is assured by the introduction of the pin 40 through the first hole 12 of the adaptor and the duct 22 of the tooth-holder 20, passing between the two arms 31, 61 of the retaining device 3, 6.

The pin 40 causes the separation of the both parallel arms 31, 61 of the retaining device 3, 6 that separate or expand inside the lowered surface 14 of the wall 110, and allows the introduction of the pin 40 until at least one of the arms 31, 61 meets at least one notch or slot 41 made on the surface of the pin 40 that houses the arm 31, 61. The pin 40 can have one or two notches 41 on one end or on both ends, depending if one or two retaining devices 3, 6 are going to be used on the intermediate or female part 10. To facilitate the user correctly inserting the pin between the two parallel arms 31, 61, the pin has to be introduced in a specific manner. Preferably, the base of the pin 40 that remains outside the male female part, to be worked with a tool, has a projection on one side that is placed in a window within the first hole on the outside of the female part.

Once the female part or intermediate 10 has to be replaced, the pin 40 has to be extracted from the coupling, and therefore the pin 40 will have to be rotated with a tool placed within a housing in the base of the pin 40 that will release the pin 40 from the arms 31, 61 as they come out of said notch or notches 41 in the pin 40. To facilitate the extraction of the pin 40, the outside surface adjacent to the first hole 12 can comprise two inclination ramps opposite to one another and concentric to said orifice or hole 12 to allow the rotation of the pin in both directions when it has to be removed.

Therefore a pin system for excavators and the like is formed by the retaining device 3, 6, the pin 40, the intermediate part or female part 10 and the male part 20.

Although during the description it is mentioned and shown in the figures that the retaining devices are attached to the side walls of the female cavity to fix in position the pins introduced laterally in the coupling, it is also possible that the retaining devices are attached to the upper and lower surfaces of the cavity and therefore the pin would be introduced from the upper or the lower side.

The invention claimed is:

1. A retaining device (3) for a female part (10) with a cavity (11) of excavators, comprising an elongated element (30) having a bent body with two arms (31) that extend from a first bent end (33) to a second end (39) opposite to the first bent end (33), wherein both arms terminate in free ends (36) at the second end, the retaining device further comprising:

attaching means on the second end (39) for coupling the retaining device (3) to a wall or surface inside the cavity (11) of the female part (10), the attaching means are in a form of hook-shaped ends (34), each terminating in the free ends, and wherein, opposite the second end, each arm comprises in the following order:

a first curve portion (c1) curved in a first direction towards the respective hook-shaped end, a first arm section (32), a second curve portion (c2) curved in a direction opposite to the first curve portion, a second arm section (35), and a third curve portion (c3), and wherein a common third section connects the third curve portion for each arm, thereby closing the first bent end, and wherein each of the first and second arm sections of one arm is substantially parallel to a corresponding section of the other arm.

2. The retaining device, according to claim 1, wherein said arms are not parallel.

3. The retaining device, according to claim 1, wherein said arms are parallel.

4. A retaining device (6) for a female part (10) with a cavity (11) of excavators, comprising an elongated element (60) having a bent body with two parallel arms (61) that extend from a first bent end (63) to a second end (69) opposite to the first bent end (63), wherein both arms terminate in free ends (62), the retaining device further comprising attaching means (66) on the second end (69) for coupling the retaining device (3) inside the cavity (11) of the female part (10), said attaching means (64, 65) comprising two components (64, 65) detachable from one another, wherein one of the two components (64) is attached to the free ends (62) of the device (6) maintaining the free ends together.

5. The retaining device, according to claim 4, wherein the two components (64, 65) are threaded to be attached and detached one from the other.

* * * * *